US009424831B2

(12) United States Patent
Hisaminato

(10) Patent No.: US 9,424,831 B2
(45) Date of Patent: Aug. 23, 2016

(54) VOICE SYNTHESIZING HAVING VOCALIZATION ACCORDING TO USER MANIPULATION

(71) Applicant: Yamaha Corporation, Hamamatsu-shi, Shizuoka-ken (JP)

(72) Inventor: Yuji Hisaminato, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 172 days.

(21) Appl. No.: 14/185,448

(22) Filed: Feb. 20, 2014

(65) Prior Publication Data

US 2014/0244262 A1 Aug. 28, 2014

(30) Foreign Application Priority Data

Feb. 22, 2013 (JP) ..... 2013-033327
Jan. 17, 2014 (JP) ..... 2014-006983

(51) Int. Cl.

| | |
|---|---|
| ***G10L 13/00*** | (2006.01) |
| ***G10L 13/06*** | (2013.01) |
| ***G10L 13/08*** | (2013.01) |
| ***G10L 13/02*** | (2013.01) |
| ***G10H 1/14*** | (2006.01) |
| ***G10H 7/00*** | (2006.01) |
| ***G10L 13/07*** | (2013.01) |
| ***G10H 1/00*** | (2006.01) |

(52) U.S. Cl.

CPC ..... *G10L 13/02* (2013.01); *G10H 1/0091* (2013.01); *G10H 1/14* (2013.01); *G10H 7/008* (2013.01); *G10L 13/07* (2013.01); *G10H 2220/096* (2013.01); *G10H 2250/455* (2013.01)

(58) Field of Classification Search

None

See application file for complete search history.

(56) References Cited

U.S. PATENT DOCUMENTS 5,293,448 A * 3/1994 Honda ..... G10L 19/08 704/208
7,110,943 B1 * 9/2006 Morii ..... G10L 19/12 704/223
8,306,813 B2 * 11/2012 Morii ..... G10L 19/032 375/219
2003/0009336 A1 1/2003 Kenmochi et al.

(Continued)

FOREIGN PATENT DOCUMENTS

EP 1 220 195 A2 7/2002
EP 1 617 408 A2 1/2006

(Continued)

OTHER PUBLICATIONS

Anonymous. (Mar. 20, 2012). "Yamaha Vocaloid Keyboard—Play Miku Songs Live! #Dig Info," Diginfo Tv, located at: <http://www.youtube.com/watch?v=d9e87KLMrng>, retrieved on May 26, 2014, one page.

(Continued)

*Primary Examiner* — Satwant Singh
(74) *Attorney, Agent, or Firm* — Morrison & Foerster LLP

(57) ABSTRACT

A voice synthesizing apparatus includes a manipulation determiner configured to determine a manipulation position which is moved according to a manipulation of a user, and a voice synthesizer configured to generate, in response to an instruction to generate a voice in which a second phoneme follows a first phoneme, a voice signal so that vocalization of the first phoneme starts before the manipulation position reaches a reference position and that vocalization from the first phoneme to the second phoneme is made when the manipulation position reaches the reference position.

20 Claims, 8 Drawing Sheets

(56) References Cited

U.S. PATENT DOCUMENTS

| | | | | |
|---|---|---|---|---|
| 2004/0215449 | A1* | 10/2004 | Roy | G10L 15/1822 704/211 |
| 2006/0015344 | A1 | 1/2006 | Kemmochi | |
| 2006/0085197 | A1 | 4/2006 | Kayama et al. | |
| 2012/0143600 | A1* | 6/2012 | Iriyama | G10L 13/08 704/207 |
| 2012/0247305 | A1 | 10/2012 | Katsuta | |
| 2012/0310650 | A1 | 12/2012 | Bonada et al. | |
| 2014/0136207 | A1* | 5/2014 | Kayama | G10L 13/08 704/258 |

FOREIGN PATENT DOCUMENTS

| | | | |
|---|---|---|---|
| EP | 2 530 671 | A2 | 12/2012 |
| JP | H08-248993 | A | 9/1996 |
| JP | 09-101780 | A | 4/1997 |
| JP | 10-149163 | A | 6/1998 |
| JP | 2002-202788 | A | 7/2002 |
| JP | 2002-202790 | A | 7/2002 |
| JP | 4039761 | B2 | 1/2008 |
| JP | 2012-103320 | A | 5/2012 |
| JP | 2012-215630 | A | 11/2012 |

OTHER PUBLICATIONS

European Search Report dated Jun. 25, 2014, for EP Application No. 14155877.5, eight pages.

Notification of Reasons for Refusal issued on Feb. 3, 2015, for JP Patent Application No. 2014-006983, with English translation, six pages.

* cited by examiner

VOICE SYNTHESIZING HAVING VOCALIZATION ACCORDING TO USER MANIPULATION

BACKGROUND

The present disclosure relates to a technique for a voice synthesis.

Voice synthesizing techniques for synthesizing a voice to be produced as corresponding to a desired character string have been proposed. For example, JP-A-2002-202790 discloses a synthesis units connection type voice synthesizing technique of synthesizing a singing voice of a song by preparing song information in which vocalization time points and vocalization characters (eg., lyrics, phonetic codes, or phonetic characters) are specified for respective notes of the song, arranging synthesis units of the vocalization characters corresponding to the notes at the respective vocalization time points on the time axis, and connecting the synthesis units to each other.

However, in the technique of JP-A-2002-202790, a singing voice having vocalization time points and vocalization characters that have been preset for respective notes is generated. The vocalization time points of respective vocalization characters cannot be varied on a real-time basis at the voice synthesis stage. In view of the above circumstances, an object of the present disclosure is to allow a user to vary vocalization time points of a synthesis voice on a real-time basis.

SUMMARY

In order to achieve the above object, according to the present disclosure, there is provided a voice synthesizing method comprising:

a determining step of determining a manipulation position which is moved according to a manipulation of a user; and a generating step of generating, in response to an instruction to generate a voice in which a second phoneme follows a first phoneme, a voice signal so that vocalization of the first phoneme starts before the manipulation position reaches a reference position and that vocalization from the first phoneme to the second phoneme is made when the manipulation position reaches the reference position.

According to the present disclosure, there is also provided a voice synthesizing apparatus comprising:

a manipulation determiner configured to determine a manipulation position which is moved according to a manipulation of a user; and a voice synthesizer configured to generate, in response to an instruction to generate a voice in which a second phoneme follows a first phoneme, a voice signal so that vocalization of the first phoneme starts before the manipulation position reaches a reference position and that vocalization from the first phoneme to the second phoneme is made when the manipulation position reaches the reference position.

This configuration or method makes it possible to control a time point when the vocalization from the first phoneme to the second phoneme is made, on a real-time basis according to a user manipulation.

DETAILED DESCRIPTION OF EXEMPLARY EMBODIMENTS

Embodiment 1

Figure 1:
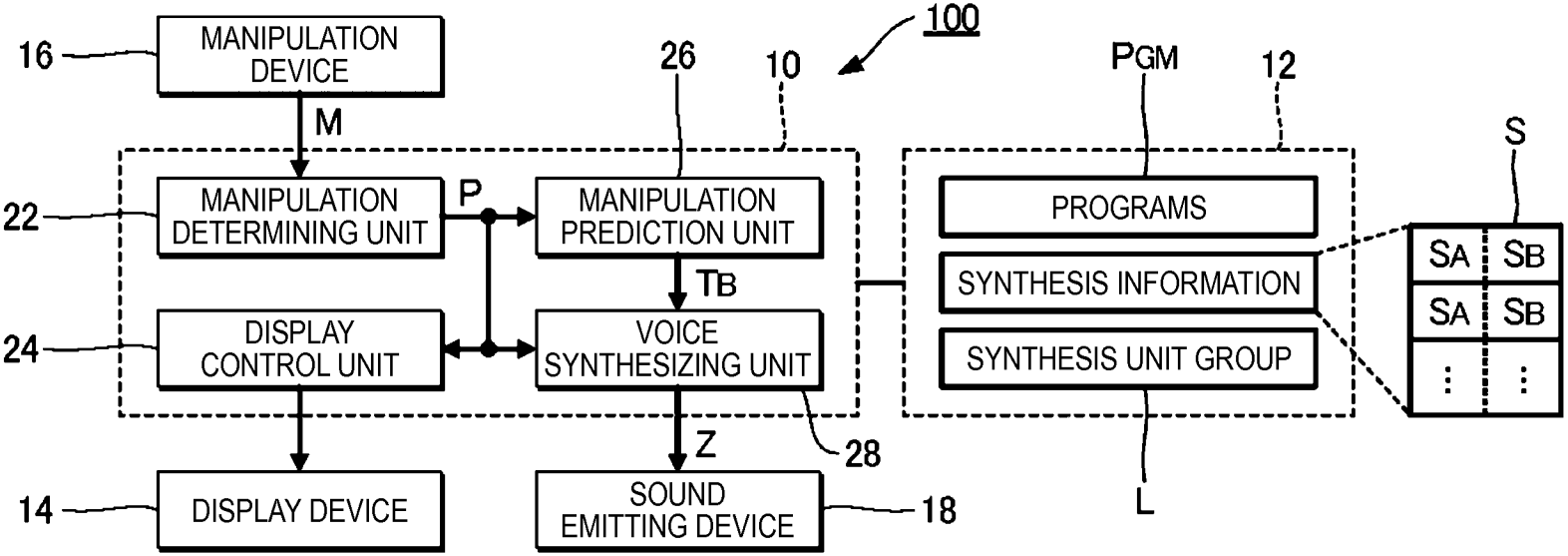
FIG. 1 is a block diagram of a voice synthesizing apparatus according to a first embodiment.

FIG. 1 is a block diagram of a voice synthesizing apparatus 100 according to a first embodiment of the present disclosure. As shown in FIG. 1, the voice synthesizing apparatus 100, which is a signal processing apparatus for generating a voice signal Z representing the waveform of a singing voice of a song, is implemented as a computer system including a computing device 10, a storage device 12, a display device 14, a manipulation device 16, and a sound emitting device 18. The computing device 10 is a control device for supervising the components of the voice synthesizing apparatus 100.

The display device 14 (e.g., liquid crystal panel) displays an image that is commanded by the computing device 10. The manipulation device 16, which is an input device for receiving a user instruction directed to the voice synthesizing apparatus 100, generates a manipulation signal M corresponding to a user manipulation. The first embodiment employs, as the manipulation device 16, a touch panel that is integral with the display device 14. That is, the manipulation device 16 detects contact of a finger of a user to the display screen of the display device 14 and outputs a manipulation signal M corresponding to a contact position. The sound emitting device 18 (e.g., speakers or headphones) reproduces sound waves corresponding to a voice signal Z generated by the computing device 10. For the sake of convenience, a D/A converter for converting a digital voice signal Z generated by the computing device 10 into an analog signal is omitted in FIG. 1.

The storage device 12 stores programs PGM to be run by the computing device 10 and various data to be used by the computing device 10. A known storage medium such as a semiconductor storage medium or a magnetic storage medium or a combination of plural kinds of storage media is employed at will as the storage device 12. In the first embodiment, the storage device 12 stores a synthesis unit group L and synthesis information S. The synthesis unit group L is a set (voice synthesis library) of plural synthesis units V to be used as materials for synthesizing a voice signal Z. Each synthesis unit V is a single phoneme (e.g., vowel or consonant) as a minimum unit of phonological discrimination or a phoneme chain (e.g., diphone or triphone) of plural phonemes.

Pieces of synthesis information S, which are time-series data that specify the details (melodies and lyrics) of individual songs, are generated in advance for the respective songs and stored in the storage device 12. As shown in FIG. 1, the synthesis information S includes pitches $S_A$ and vocalization codes $S_B$ for respective notes that constitute melodies of singing parts of a song. The pitch $S_A$ is a numerical value (e.g., note number) that means a pitch of a note. The vocalization code $S_B$ is a code that specifies utter contents to be uttered as corresponding to an emitting of a note. In the first embodiment, the vocalization code $S_B$ corresponds to one of syllables (units of vocalization) constituting the lyrics of a song. A voice signal Z of a singing voice of a song is generated through voice synthesis that utilizes the synthesis information S. In the first embodiment, vocalization time points of respective notes of a song are controlled according to user instructions made on the manipulation device 16. Therefore, whereas the order of plural notes constituting a song is specified by the synthesis information S, the vocalization time points and the durations of the respective notes in the synthesis information S are not specified.

The computing device 10 realizes plural functions (manipulation determining unit 22, display control unit 24, manipulation prediction unit 26, and voice synthesizing unit 28) for generating a voice signal Z by running the programs PGM stored in the storage device 12. A configuration in which the individual functions of the computing device 10 are distributed to plural integrated circuits and a configuration in which a dedicated electronic circuit (e.g., DSP) is in charge of part of the functions of the computing device 10 are also possible.

Figure 2:
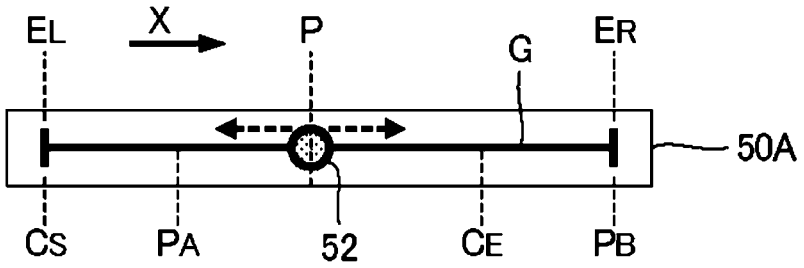
FIG. 2 illustrates a manipulation position.

The display control unit 24 displays, on the display unit 14, a manipulation picture 50A shown in FIG. 2 to be viewed by the user in manipulating the manipulation device 16. The manipulation picture 50A shown in FIG. 2 is a slider-type image including a line segment (hereinafter referred to as a "manipulation path") G extending in the X direction between a left end $E_L$ and a right end $E_R$ and a manipulation mark (pointer) 52 placed on the manipulation path G. The manipulation determining unit 22 shown in FIG. 1 determines a position (hereinafter referred to as a "manipulation position") P specified by the user on the manipulation path G on the basis of a manipulation signal M supplied from the manipulation device 16. The user touches the manipulation path G of the display screen of the display device 14 at any position with a finger and thereby specifies that position as a manipulation position P. And the user can move the manipulation position P in the X direction between the left end $E_L$ and the right end $E_R$ by moving the finger along the manipulation path G while keeping the finger in contact with the display screen (drag manipulation). That is, the manipulation determining unit 22 determines a manipulation position P as moved in the X direction according to a user manipulation that is made on the manipulation device 16. The display control unit 24 places the manipulation mark 52 at the manipulation position P determined by the manipulation determining unit 22 on the manipulation path G. That is, the manipulation mark 52 is a figure (a circle in the example of FIG. 2) indicating the manipulation position P, and is moved in the X direction between the left end $E_L$ and the right end $E_R$ according to a user instruction made on the manipulation device 16.

The user can specify, at will, a vocalization time point of each note indicated by the synthesis information S by moving the manipulation position P by manipulating the manipulation device 16 as a voice signal Z is reproduced. More specifically, the user moves the manipulation position P from a position other than a particular position (hereinafter referred to as a "reference position") $P_B$ on the manipulation path G toward the reference position $P_B$ so that the manipulation position P reaches the reference position $P_B$ at a time point (hereinafter referred to as an "instruction time point") $T_B$ that is desired by the user as a time point when vocalization of one note of the song should be started. In the first embodiment, as shown in FIG. 2, the right end $E_R$ of the manipulation path G is employed as the reference position $P_B$. That is, the user sets the manipulation position P, for example, at the left end $E_L$ by touching the left end $E_L$ on the display screen with a finger before arrival of a desired instruction time point $T_B$ of one note of the song and then moves the finger in the X direction while keeping the finger in contact with the display screen so that the manipulation position P reaches the reference position $P_B$ (right end $E_R$) at the desired instruction time point $T_B$. In this example, the manipulation position P is set at the left end $E_L$. However, the manipulation position P may be set at a position on the manipulation path G other than the left end $E_L$.

The user successively performs manipulations as described above (hereinafter referred to as "vocalization commanding manipulations") of moving the manipulation position P to the reference position $P_B$ for respective notes (syllables of the lyrics) as the voice signal Z is reproduced. As a result, instruction time points $T_B$ that are set by the respective vocalization commanding manipulations are specified as vocalization time points of the respective notes of the song.

The manipulation prediction unit 26 shown in FIG. 1 predicts (estimates) an instruction time point $T_B$ before the manipulation position P actually reaches the reference position $P_B$ (right end $E_R$) on the basis of a movement speed v at which the manipulation position P moves before reaching the reference position $P_B$. More specifically, the manipulation prediction unit 26 predicts an instruction time point $T_B$ on the basis of a time length $\tau$ that the manipulation position P takes to move a distance $\delta$ from a prediction start position $C_S$ that is set on the manipulation path G to a prediction execution position $C_E$. In the first embodiment, as shown in FIG. 2, for example, the left end $E_L$ is employed as the prediction start position $C_S$. On the other hand, the prediction execution position $C_E$ is a position on the manipulation path G located between the prediction start position $C_S$ (left end $E_L$) and the reference position $P_B$ (right end $E_R$).

Figure 3:
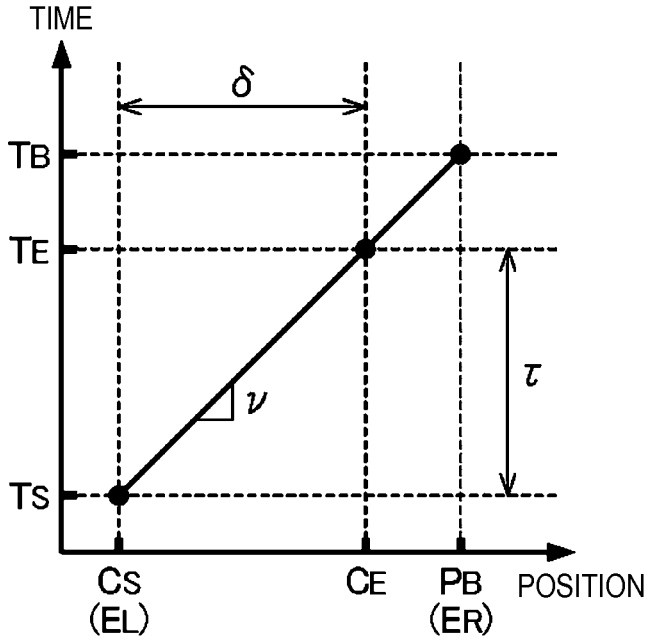
FIG. 3 illustrates how a manipulation prediction unit operates.

FIG. 3 illustrates how the manipulation prediction unit 26 operates, and shows a time variation of the manipulation position P (horizontal axis). As shown in FIG. 3, the manipulation prediction unit 26 calculates a movement speed v by measuring a time length $\tau$ that has elapsed with a vocalization commanding manipulation from a time point $T_S$ at which the manipulation position P started from the prediction start position $C_S$ to a time point $T_E$ when the manipulation position P passes the prediction execution position $C_E$ and dividing the distance $\delta$ between the prediction start position $C_S$ and the prediction execution position $C_E$ by the time length $\tau$. Then the manipulation prediction unit 26 calculates, as an instruction time point $T_B$, a time point when the manipulation position P will reach the reference position $P_B$ with an assumption that the manipulation position P moved and will move in the X direction from the prediction start position $C_S$ at the constant speed that is equal to the movement speed v. Although in the above example it is assumed that the movement speed v of the manipulation position P is constant, it is also possible to predict an instruction time point $T_B$ taking increase or decrease of the movement speed v into consideration.

The voice synthesizing unit 28 shown in FIG. 1 generates a voice signal Z of a singing voice of the song that is defined by the synthesis information S. In the first embodiment, the voice synthesizing unit 28 generates a voice signal Z by synthesis units connection type voice synthesis in which the synthesis units V of the synthesis unit group L stored in the storage device 12. More specifically, the voice synthesizing unit 28 generates a voice signal Z by successively selecting, from the synthesis unit group L, synthesis units V corresponding to respective vocalization codes $S_B$ of the synthesis information S for the respective notes, adjusting the individual synthesis units V so as to give them pitches $S_A$ specified for the respective notes, and connecting the resulting synthesis units V to each other. In the voice signal Z, the time point when a voice of each note is produced (i.e., the position on the time axis where each synthesis unit is to be located) is controlled on the basis of an instruction time point $T_B$ that was predicted by the manipulation prediction unit 26 when a vocalization commanding manipulation corresponding to the note was made.

Figure 4:
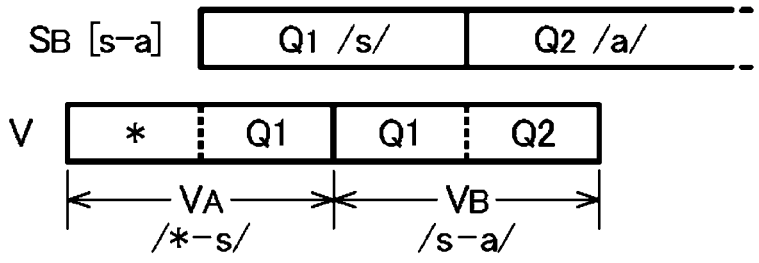
FIG. 4 illustrates a relationship between a vocalization code (phonemes) and synthesis units.

As shown in FIG. 4, operations of the manipulation prediction unit 26 and the voice synthesizing unit 28 are explained, by referring to a note in which a vocalization code $S_B$ is assigned by the synthesis information S. The vocalization code $S_B$ is constituted by a phoneme $Q_1$ and a phoneme $Q_2$ which is subsequent to the phoneme $Q_1$. Assuming Japanese lyrics, a typical case is that the phoneme $Q_1$ is a consonant and the phoneme $Q_2$ is a vowel. For example, in the case of a vocalization code $S_B$ of a syllable "さ[s-a]," the vowel phoneme /a/($Q_2$) follows the consonant phoneme /s/($Q_1$). As shown in FIG. 4, the voice synthesizing unit 28 selects synthesis units $V_A$ and $V_B$ corresponding to the vocalization code $S_B$ from the synthesis unit group L. As shown in FIG. 4, each of the synthesis units $V_A$ and $V_B$ is a phoneme chain (diphone) that is a connection of a start-side phoneme (hereinafter referred to as a "front phoneme") and an end-side phoneme (hereinafter referred to as a "rear phoneme") of the synthesis unit.

The rear phoneme of the synthesis unit $V_A$ corresponds to the phoneme $Q_1$ of the vocalization code $S_B$. The front phoneme and the rear phoneme of the synthesis unit $V_B$ correspond to the phonemes $Q_1$ and $Q_2$ of the vocalization code $S_B$, respectively. For example, in the above example vocalization code $S_B$ (syllable "さ[s-a]") in which the phoneme /a/($Q_2$) follows the phoneme /s/($Q_1$), a phoneme chain /*-s/ whose rear phoneme is a phoneme /s/ is selected as the synthesis unit $V_A$ and a phoneme chain /s-a/ whose front phoneme is a phoneme /s/ and rear phoneme is a phoneme /a/ is selected as the synthesis unit $V_B$. The symbol "*" that is given to the front phoneme of the synthesis unit $V_A$ means a particular phoneme $Q_2$ corresponding to the immediately preceding vocalization code $S_B$ or silence /#/.

Incidentally, assume a case of singing a syllable in which a vowel follows a consonant. In actual singing of a song, there is a tendency that vocalization of the vowel, rather than the consonant, of the syllable (i.e., the rear phoneme of the syllable) is started at the start point of the note. In the first embodiment, to reproduce this tendency, the voice synthesizing unit 28 generates a voice signal Z so that vocalization of the phoneme $Q_1$ is started before arrival of the instruction time point $T_B$ and vocalization of the phoneme $Q_2$ is started at the instruction time point $T_B$. A specific description will be made below.

Using the manipulation device 16 properly, the user moves the manipulation position P in the X direction from the left end $E_L$ (prediction start position $C_S$) on the manipulation path G. As seen from FIG. 5, the voice synthesizing unit 28 generates a voice signal Z so that vocalization of the synthesis unit $V_A$ (front phoneme /*/) is started at a time point $T_A$ when the manipulation position P passes a particular position (hereinafter referred to as a "vocalization start position") $P_A$ that is set on the manipulation path G. That is, the start point of the synthesis unit $V_A$ approximately coincides with the time point $T_A$ when the manipulation position P passes the vocalization start position $P_A$.

The voice synthesizing unit 28 sets the vocalization start position $P_A$ on the manipulation path G variably in accordance with the kind of the phoneme $Q_1$. For example, the storage device 12 is stored with a table in which vocalization start positions $P_A$ are registered for respective kinds of phonemes $Q_1$, and the voice synthesizing unit 28 determines a vocalization start position $P_A$ corresponding to a phoneme $Q_1$ of a vocalization code $S_B$ of the synthesis information S using the table stored in the storage device 12. The relationships between kinds of phonemes $Q_1$ and vocalization start positions $P_A$ may be set at will. For example, the vocalization start positions $P_A$ of such phonemes as plosives and affricates whose acoustic characteristics vary unsteadily in a short time and lasts only a short time are set later than those of such phonemes as fricatives and nasals that may last steadily. For example, the vocalization start position $P_A$ of a plosive phoneme /t/ may be set at a 50% position from the left end $E_L$ on the manipulation path G. The vocalization start position $P_A$ of a fricative phoneme /s/ may be set at a 20% position from the left end $E_L$ on the manipulation path G. However, the vocalization start positions $P_A$ of these phonemes are not limited to the above example values (50% and 20%).

When the manipulation position P has been moved in the X direction and has passed the prediction start position $C_S$, the manipulation prediction unit 26 calculates an instruction time point $T_B$ when the manipulation position P will reach the reference position $P_B$ on the basis of a time length $\tau$ between a time point $T_S$ when the manipulation position P left the prediction start position $C_S$ and a time point $T_E$ when the manipulation position P has passed the prediction execution position $C_E$.

The manipulation prediction unit 26 sets the prediction execution position $C_E$ (distance $\delta$) on the manipulation path G variably in accordance with the kind of the phoneme $Q_1$. For example, the storage device 12 is stored with a table in which prediction execution positions $C_E$ are registered for respective kinds of phonemes $Q_1$, and the manipulation prediction unit 26 determines a prediction execution position $C_E$ corresponding to a phoneme $Q_1$ of a vocalization code $S_B$ of the synthesis information S using the table stored in the storage device 12. The relationships between kinds of phonemes $Q_1$ and prediction execution positions $C_E$ may be set at will. For example, the prediction execution positions $C_E$ of such phonemes as plosives and affricates whose acoustic characteristics vary unsteadily in a short time and lasts only a short time are set closer to the left end $E_L$ than those of such phonemes as fricatives and nasals that may last steadily.

Figure 5:
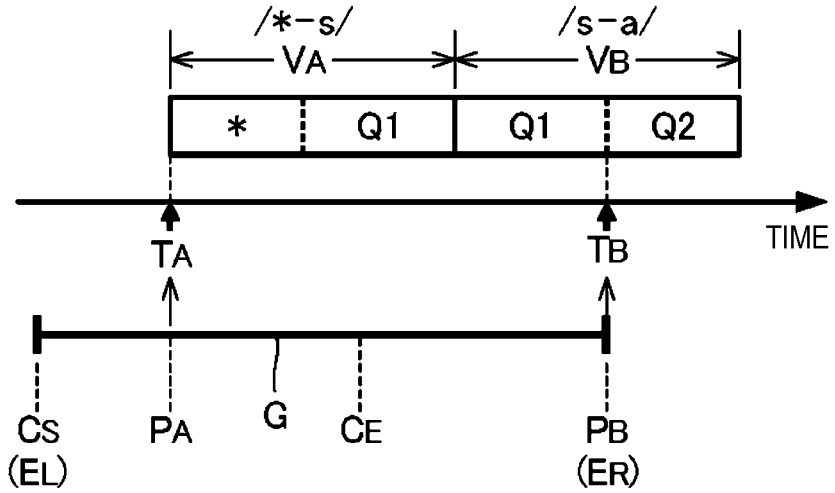
FIG. 5 illustrates voice synthesizing unit operates.

As shown in FIG. 5, the voice synthesizing unit 28 generates a voice signal Z so that vocalization of the phoneme $Q_2$ of the synthesis unit $V_B$ is started at the instruction time point $T_B$ that has been determined by the manipulation prediction unit 26. More specifically, vocalization of the phoneme (front phoneme) $Q_1$ of the synthesis unit $V_B$ is started following the phoneme $Q_1$ of the synthesis unit $V_A$ that was started at the vocalization start position $P_A$ before arrival of the instruction time point $T_B$, and vocalization from the phoneme $Q_1$ of the synthesis unit $V_B$ to the phoneme (rear phoneme) $Q_2$ of the synthesis unit $V_B$ is made at the instruction time point $T_B$. That is, the start point of the phoneme $Q_2$ of the synthesis unit $V_B$ (i.e., the boundary between the phonemes $Q_1$ and $Q_2$) approximately coincides with the time point $T_B$ that has been determined by the manipulation prediction unit 26.

The voice synthesizing unit 28 expands or contracts the phoneme $Q_1$ of the synthesis unit $V_A$ and the phoneme $Q_1$ of the synthesis unit $V_B$ as appropriate on the time axis so that the phoneme $Q_1$ continues until the instruction time point $T_B$. For example, the phoneme(s) $Q_1$ is elongated by repeating, on the time axis, an interval when the acoustic characteristics are kept steadily of one or both of the phonemes $Q_1$ of the synthesis units $V_A$ and $V_B$ (e.g., a start-point-side interval of the phoneme $Q_1$ of the synthesis unit $V_B$). The phoneme(s) $Q_1$ is shortened by thinning voice data in that interval as appropriate. As is understood from the above description, the voice synthesizing unit 28 generates a voice signal Z with which vocalization of the phoneme $Q_1$ is started before arrival of the instruction time point $T_B$ when the manipulation position P is expected to reach the reference position $P_B$ and vocalization from the phoneme $Q_1$ to the phoneme $Q_2$ is made when the instruction time point $T_B$ arrives.

Figure 6:
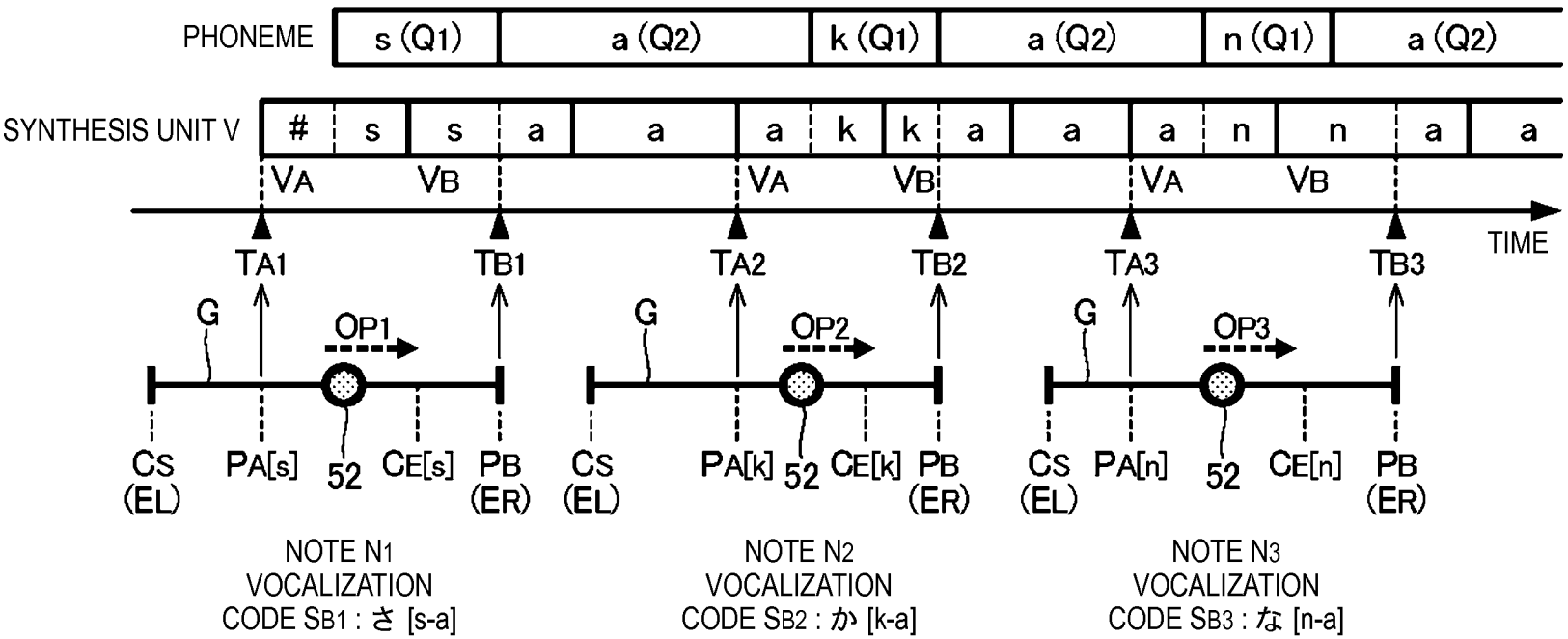
FIG. 6 illustrates, more specifically, voice synthesizing unit operates.

Processing as described above which is performed according to a vocalization commanding manipulation for each note specified by the synthesis information S is repeated successively. FIG. 6 illustrates example vocalization time points of individual phonemes (synthesis units V) in the case where a word "さかな [s-a][k-a][n-a]" is specified by synthesis information S. More specifically, a syllable "さ [s-a]" is designated as a vocalization code $S_{B1}$ of a note $N_1$ of a song, "か [k-a]" is designated as a vocalization code $S_{B2}$ of a note $N_2$, and "な [n-a]" is designated as a vocalization code $S_{B3}$ of a note $N_3$.

As seen from FIG. 6, when the user performs a vocalization commanding manipulation $OP_1$ for the note $N_1$ for which the syllable "さ [s-a]" is designated, vocalization of a synthesis unit /#-s/ (synthesis unit $V_A$) is started when the manipulation position P passes a vocalization start position $P_A$[s] corresponding to a phoneme /s/($Q_1$). Then vocalization of a phoneme /s/ of a synthesis unit /s-a/ (synthesis unit $V_B$) which is a connection of the phoneme /s/ and a phoneme /a/($Q_2$) is started immediately after the vocalization of the synthesis unit /#-s/. And vocalization of a phoneme /a/ of the synthesis unit /s-a/ is started at an instruction time point $T_{B1}$ that was determined by the manipulation prediction unit 26 at a time point $T_E$ when the manipulation position P passed a prediction execution position $C_E$[s] corresponding to the phoneme /s/.

Likewise, when a vocalization commanding manipulation $OP_2$ for the note $N_2$ for which the syllable "か [k-a]" is designated, vocalization of a synthesis unit /a-k/ (synthesis unit $V_A$) is started at a time point $T_{A2}$ when the manipulation position P passes a vocalization start position $P_A$[k] corresponding to a phoneme /k/($Q_1$) and vocalization of a synthesis unit /k-a/ (synthesis unit $V_B$) is started thereafter. And vocalization of a phoneme /a/(Q2) of the synthesis unit /k-a/ is started at an instruction time point $T_{B2}$ that was determined at a time point $T_E$ when the manipulation position P passed a prediction execution position $C_E$[k] corresponding to the phoneme /k/.

When a vocalization commanding manipulation $OP_3$ for the note $N_3$ for which the syllable "な [n-a]" is designated, vocalization of a synthesis unit /a-n/ (synthesis unit $V_A$) is started at a time point $T_{A3}$ when the manipulation position P passes a vocalization start position $P_A$[n] corresponding to a phoneme /n/($Q_1$) and vocalization of a synthesis unit /n-a/ (synthesis unit $V_B$) is started thereafter. And vocalization of a phoneme /a/(Q2) of the synthesis unit /n-a/ is started at an instruction time point $T_{B3}$ that was determined at a time point $T_E$ when the manipulation position P passed a prediction execution position $C_E$[n] corresponding to the phoneme /n/.

Figure 7:
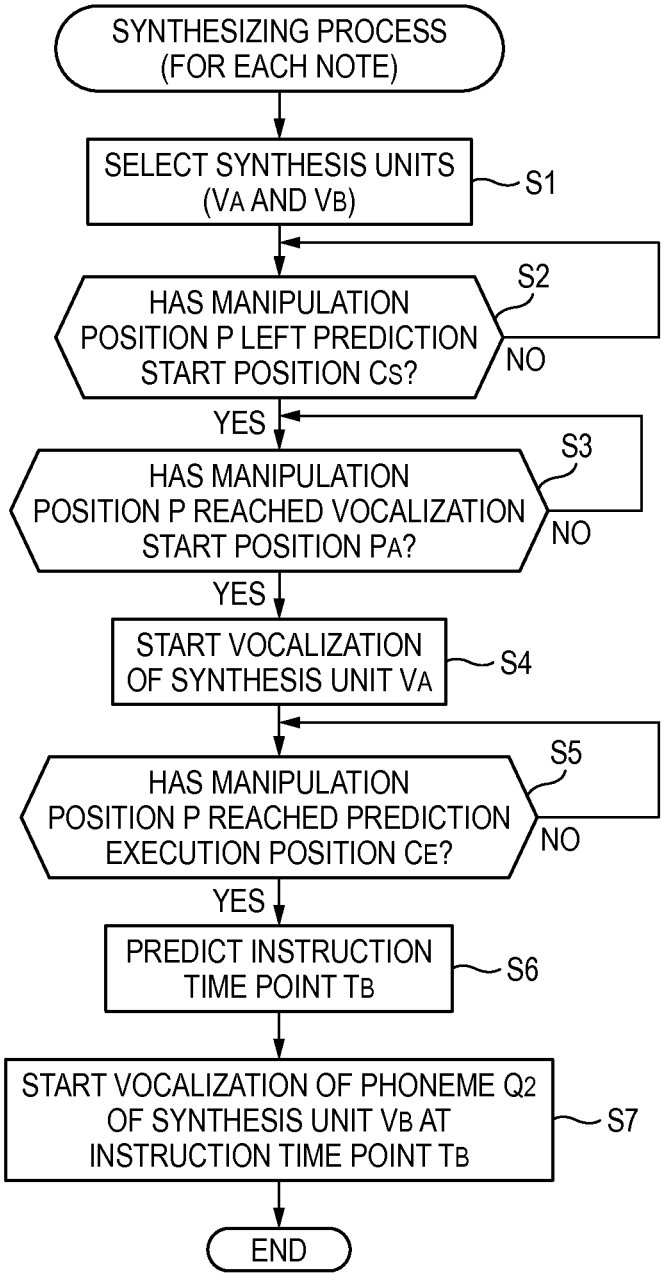
FIG. 7 is a flowchart of a synthesizing process.

FIG. 7 is a flowchart of a process (hereinafter referred to as a "synthesizing process") which is executed by the manipulation prediction unit 26 and the voice synthesizing unit 28. The synthesizing process of FIG. 7 is executed for each of notes that are specified by synthesis information S in time series. Upon a start of the synthesizing process, at step S1, the voice synthesizing unit 28 selects synthesis units V ($V_A$ and $V_B$) corresponding to a vocalization code $S_B$ of a note to be processed from the synthesis unit group L.

The voice synthesizing unit 28 stands by until the manipulation position P which is determined by the manipulation determining unit 22 leaves a prediction start position $C_S$ (S2: NO). If the manipulation position P leaves the prediction start position $C_S$ (S2: YES), the voice synthesizing unit 28 stands by until the manipulation position P reaches a vocalization start position $P_A$ (S3: NO). If the manipulation position P reaches the vocalization start position $P_A$ (S3: YES), at step S4 the voice synthesizing unit 28 generates a portion of a voice signal Z so that vocalization of the synthesis unit $V_A$ is started.

The manipulation prediction unit 26 stands by until the manipulation position P that passed the vocalization start position $P_A$ reaches a prediction execution position $C_E$ (S5: NO). If the manipulation position P reaches the prediction execution position $C_E$ (S5: YES), at step S6 the manipulation prediction unit 26 predicts an instruction time point $T_B$. At step S7, the voice synthesizing unit 28 generates a portion of the voice signal Z so that vocalization of a phoneme $Q_1$ of the synthesis unit $V_B$ is started before arrival of the instruction time point $T_B$ and vocalization of a phoneme $Q_2$ of the synthesis unit $V_B$ is started at the instruction time point $T_B$.

As described above, in the first embodiment, the vocalization time point (time point $T_A$ or instruction time point $T_B$) of each phoneme of a vocalization code $S_B$ is controlled according to a vocalization commanding manipulation, which provides an advantage that vocalization time point of each note in a voice signal can be varied on a real-time basis. Furthermore, in the first embodiment, when synthesis of a voice of a vocalization code $S_B$ in which a phoneme $Q_2$ follows a phoneme $Q_1$ has been commanded, a voice signal Z is generated so that vocalization of the phoneme $Q_1$ is started before arrival of an instruction time point $T_B$ and a transition from the phoneme $Q_1$ to the phoneme $Q_2$ of the synthesis unit $V_B$ is made at the instruction time point $T_B$. This provides an advantage that a voice signal Z that is natural in terms of auditory sense can be generated because of reproduction of the tendency that in singing, for example, a syllable in which a vowel follows a consonant, vocalization of the consonant is started before a start point of the note and vocalization of the vowel is started at the start point of the note.

A synthesis unit $V_B$ (diphone) in which a phoneme $Q_1$ exists immediately before a phoneme $Q_2$ is used for generation of a voice signal Z. In a general configuration in which vocalization of a synthesis unit $V_B$ is started at a time point (hereinafter referred to as an "actual instruction time point") when the manipulation position P reaches a reference position $P_B$ actually, vocalization of the phoneme (rear phoneme) $Q_2$ is started at a time point that is later than the actual instruction time point by the duration of the phoneme (front phoneme) $Q_1$ of the synthesis unit $V_B$. That is, the start of vocalization of the phoneme $Q_2$ is delayed from the actual instruction time point.

In contrast, in the first embodiment, since an instruction time point $T_B$ is predicted before the manipulation position P reaches the reference position $P_B$ actually, an operation is possible that vocalization of the phoneme $Q_1$ of the synthesis unit $V_B$ is started before arrival of the instruction time point $T_B$ and vocalization of the phoneme $Q_2$ of the synthesis unit $V_B$ is started at the instruction time point $T_B$. This provides an advantage that the delay of the phoneme $Q_2$ from a time point intended by the user (i.e., the time point when the manipulation position P reaches the reference position $P_B$) can be reduced.

Furthermore, in the first embodiment, the vocalization start position $P_A$ on the manipulation path G is controlled variably in accordance with the kind of the phoneme $Q_1$. This provides an advantage that vocalization of the phoneme $Q_1$ can be started at a time point that is suitable for the kind of the phoneme $Q_1$. Still further, in the first embodiment, the prediction execution position $C_E$ on the manipulation path G is controlled variably in accordance with the kind of the phoneme $Q_1$. Therefore, the prediction of an instruction time point $T_B$ can reflect an interval, suitable for a kind of the phoneme $Q_1$, of the manipulation path G.

Embodiment 2

A second embodiment of the present disclosure will be described below. In each of the embodiments to be described below, elements that are the same (or equivalent) in operation or function as in the first embodiment will be given the same reference symbols as corresponding elements in the first embodiment and detailed descriptions therefor will be omitted where appropriate.

Figure 8:
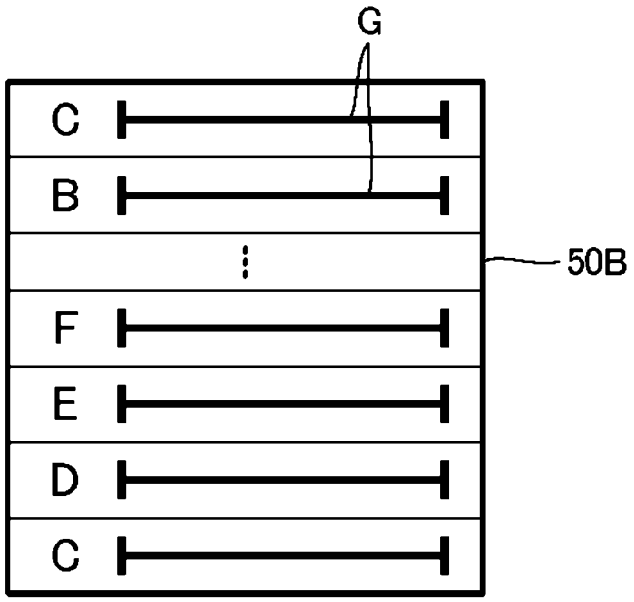
FIG. 8 is a schematic diagram of a manipulation picture used in a second embodiment.

FIG. 8 is a schematic diagram of a manipulation picture 50B used in the second embodiment. As shown in FIG. 8, plural manipulation paths G corresponding to different pitches $S_A$ (C, D, E, . . . ) are arranged in the manipulation picture 50B used in the second embodiment. The user selects one manipulation path (hereinafter referred to as a "subject manipulation path") G that corresponds to a desired pitch $S_A$ from the plural manipulation paths G in the manipulation picture 50B and performs a vocalization commanding manipulation in the same manner as in the first embodiment. The manipulation determining unit 22 determines a manipulation position P on the subject manipulation path G that has been selected from the plural manipulation paths G in the manipulation picture 50B, and the display control unit 24 places a manipulation mark 52 at the manipulation position P on the subject manipulation path G. That is, the subject manipulation path G is a manipulation path G that is selected by the user as a subject of a vocalization commanding manipulation for moving the manipulation position P. Selection of a subject manipulation path G (selection of a pitch $S_B$) and a vocalization commanding manipulation on the subject manipulation path G which are made for each note of a song are repeated successively.

The voice synthesizing unit 28 used in the second embodiment generates a portion of a voice signal Z having a pitch $S_A$ that corresponds to a subject manipulation path G selected by the user from the plural manipulation paths G. That is, the pitch of each note of a voice signal Z is set to the pitch $S_A$ of the subject manipulation path G that has been selected by the user from the plural manipulation paths G as a subject of a vocalization commanding manipulation for the note. The pieces of processing relating to the vocalization code $S_B$ and the vocalization time point of each note are the same as in the first embodiment. As is understood from the above description, whereas in the first embodiment a pitch of each note of a song is specified in advance as part of synthesis information S, in the second embodiment a pitch $S_A$ of each note of a song is specified on a real-time basis (i.e., pitches $S_A$ of respective notes are specified successively as a voice signal Z is generated) through selection of a subject manipulation path G by the user. Therefore, in the second embodiment, it is possible to omit pitches $S_A$ of respective notes in synthesis information S.

The second embodiment provides the same advantages as in the first embodiment. Furthermore, in the second embodiment, a portion of a voice signal Z for a voice having a pitch $S_A$ corresponding to a subject manipulation path G selected by the user from the plural manipulation paths G is generated. This provides an advantage that the user can easily specify, on a real-time basis, a pitch $S_A$ of each note of a song as well as a vocalization time point of each note.

Embodiment 3

Figure 9:
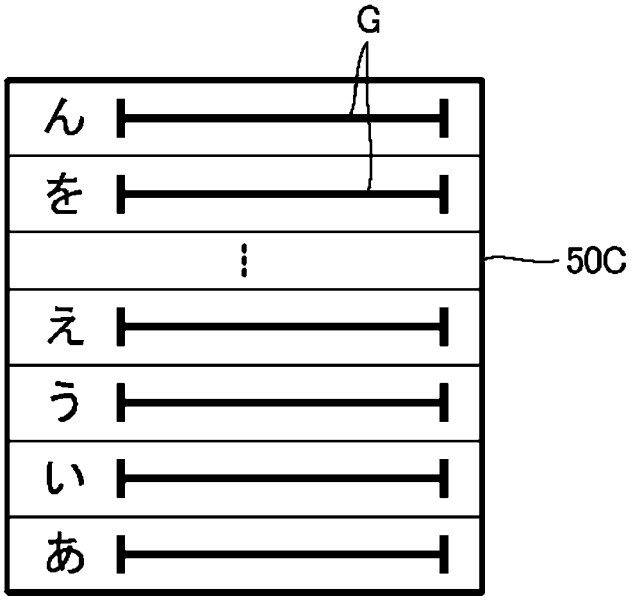
FIG. 9 is a schematic diagram of a manipulation picture used in a third embodiment.

FIG. 9 is a schematic diagram of a manipulation picture 50C used in a third embodiment. As shown in FIG. 9, plural manipulation paths G corresponding to different vocalization codes $S_B$ (syllables) are arranged in the manipulation picture 50C used in the third embodiment. The user selects, as a subject manipulation path, one manipulation path G that corresponds to a desired vocalization code $S_B$ from the plural manipulation paths G in the manipulation picture 50C and performs a vocalization commanding manipulation in the same manner as in the first embodiment. The manipulation determining unit 22 determines a manipulation position P on the subject manipulation path G that has been selected from the plural manipulation paths G in the manipulation picture 50C, and the display control unit 24 places a manipulation mark 52 at the manipulation position P on the subject manipulation path G. Selection of a subject manipulation path G (selection of a vocalization code $S_B$) and a vocalization commanding manipulation on the subject manipulation path G which are made for each note of a song are repeated successively.

The voice synthesizing unit 28 used in the third embodiment generates a portion of a voice signal Z for a vocalization code $S_B$ that corresponds to a subject manipulation path G selected by the user from the plural manipulation paths G. That is, the vocalization code of each note of a voice signal Z is set to the vocalization code $S_B$ of the subject manipulation path G that has been selected by the user from the plural manipulation paths G as a subject of a vocalization commanding manipulation for the note. The pieces of processing relating to the pitch $S_A$ and the vocalization time point of each note are the same as in the first embodiment. As is understood from the above description, whereas in the first embodiment a vocalization code $S_B$ each note of a song is specified in advance as part of synthesis information S, in the third embodiment a vocalization code $S_B$ of each note of a song is specified on a real-time basis (i.e., vocalization codes $S_B$ of respective notes are specified successively as a voice signal Z is generated) through selection of a subject manipulation path G by the user. Therefore, in the third embodiment, it is possible to omit vocalization codes $S_B$ of respective notes in synthesis information S.

The third embodiment provides the same advantages as in the first embodiment. Furthermore, in the third embodiment, a portion of a voice signal Z for a vocalization code $S_B$ corresponding to a subject manipulation path G selected by the user from the plural manipulation paths G is generated. This provides an advantage that the user can easily specify, on a real-time basis, a vocalization code $S_B$ of each note of a song as well as a vocalization time point of each note.

Embodiment 4

In the first embodiment, the vocalization time point of each note is controlled according to a vocalization commanding manipulation of moving the manipulation position P in the direction (hereinafter referred to as an "$X_R$ direction") that goes from the left end $E_L$ to the right end $E_R$ of the manipulation path G. However, it is also possible to control the vocalization time point of each note according to a vocalization commanding manipulation of moving the manipulation position P in the direction (hereinafter referred to as an "$X_L$ direction") that goes from the right end $E_R$ to the left end $E_L$.

In the fourth embodiment, the vocalization time point of each note is controlled in accordance with the direction ($X_R$ direction or $X_L$ direction) of a vocalization commanding manipulation. More specifically, the user reverses the manipulation position P movement direction of the vocalization commanding manipulation on a note-by-note basis. For example, the vocalization commanding manipulation is performed in the $X_R$ direction for odd-numbered notes of a song and in the $X_L$ direction for even-numbered notes. That is, the manipulation position P (manipulation mark 52) is reciprocated between the left end $E_L$ and the right end $E_R$.

Figure 10:
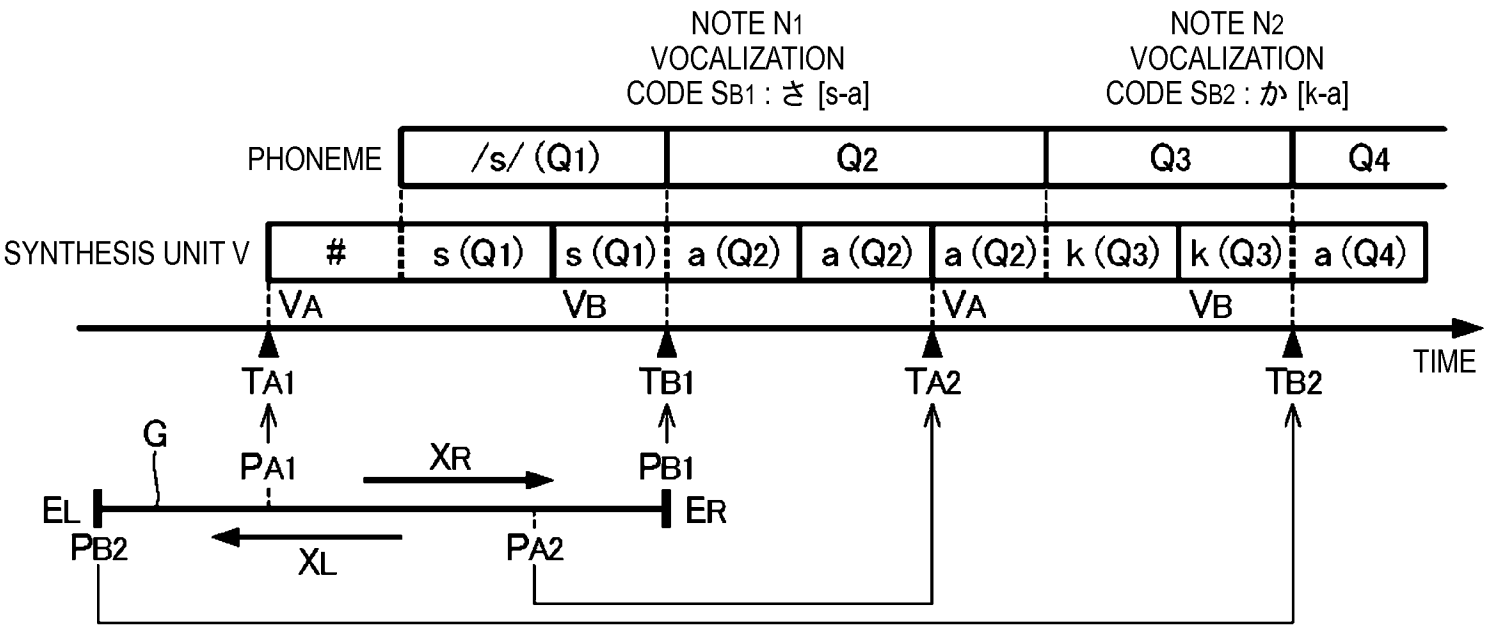
FIG. 10 illustrates how a voice synthesizing unit used in a fourth embodiment operates.

As shown in FIG. 10, attention is paid to adjoining notes $N_1$ and $N_2$ of a song. The note $N_2$ is located immediately after the note $N_1$. Assume that the note $N_1$ is assigned a vocalization code $S_{B1}$ in which a phoneme $Q_2$ follows a phoneme $Q_1$ and the note $N_2$ is assigned a vocalization code $S_{B2}$ in which a phoneme $Q_4$ follows a phoneme $Q_3$. In the case of a word "さか [s-a][k-a]," the syllable "さ [s-a]" corresponding to the vocalization code $S_{B1}$ consists of a phoneme /s/($Q_1$) and a phoneme /a/($Q_2$) and the syllable "か [k-a]" corresponding to the vocalization code $S_{B2}$ consists of a phoneme /k/($Q_3$) and a phoneme /a/($Q_4$). For the note $N_1$, the user performs a vocalization commanding manipulation of moving the manipulation position P in the $X_R$ direction which goes from the right end $E_R$ to the left end $E_L$. For the note $N_2$ which immediately follows the note $N_1$, the user performs a vocalization commanding manipulation of moving the manipulation position P in the $X_L$ direction which goes from the left end $E_L$ to the right end $E_R$.

As soon as the user starts a vocalization commanding manipulation in the $X_R$ direction for the note $N_1$, the manipulation prediction unit 26 employs, as a reference position $P_{B1}$ (first reference position), the right end $E_R$ which is located downstream in the $X_R$ direction and predicts, as an instruction time point $T_{B1}$, a time point when the manipulation position P will reach the reference position $P_{B1}$. The voice synthesizing unit 28 generates a voice signal Z so that vocalization of the phoneme $Q_1$ of the vocalization code $S_{B1}$ of the note $N_1$ is started before arrival of the instruction time point $T_{B1}$ and a transition from the phoneme $Q_1$ to the phoneme $Q_2$ is made at the instruction time point $T_{B1}$.

On the other hand, as soon as the user starts a vocalization commanding manipulation in the $X_L$ direction for the note $N_1$ by reversing the movement direction of the manipulation position P, the manipulation prediction unit 26 employs, as a reference position $P_{B2}$ (second reference position), the left end $E_L$ which is located downstream in the $X_L$ direction and predicts, as an instruction time point $T_{B2}$, a time point when the manipulation position P will reach the reference position $P_{B2}$. The voice synthesizing unit 28 generates a voice signal Z so that vocalization of the phoneme $Q_3$ of the vocalization code $S_{B2}$ of the note $N_2$ is started before arrival of the instruction time point $T_{B2}$ and a transition of vocalization from the phoneme $Q_3$ to the phoneme $Q_4$ is made at the instruction time point $T_{B2}$.

Processing as described above is performed for each adjoining pair of notes ($N_1$ and $N_2$) of the song, whereby the vocalization time point of each note of the song is controlled according to one of vocalization commanding manipulations in the $X_R$ direction and the $X_L$ direction (i.e., manipulations of reciprocating the manipulation position P).

The fourth embodiment provides the same advantages as the first embodiment. Furthermore, since the vocalization time points of individual notes of a song are specified by reciprocating the manipulation position P, the fourth embodiment also provides an advantage that the load that the user bears in making vocalization commanding manipulations (i.e., manipulations of moving a finger for individual notes) can be made lower than in a configuration in which the manipulation position P is moved in the single direction irrespective of the note of a song.

Embodiment 5

In the above-described second embodiment, a portion of a voice signal Z is generated that has a pitch $S_A$ corresponding to a subject manipulation path G selected by the user from plural manipulation paths G. In a fifth embodiment, one manipulation path G is displayed on the display device 14 and the pitch $S_A$ of a voice signal Z is controlled in accordance with where the manipulation position P is located in the direction that is perpendicular to the manipulation path G.

Figure 11:
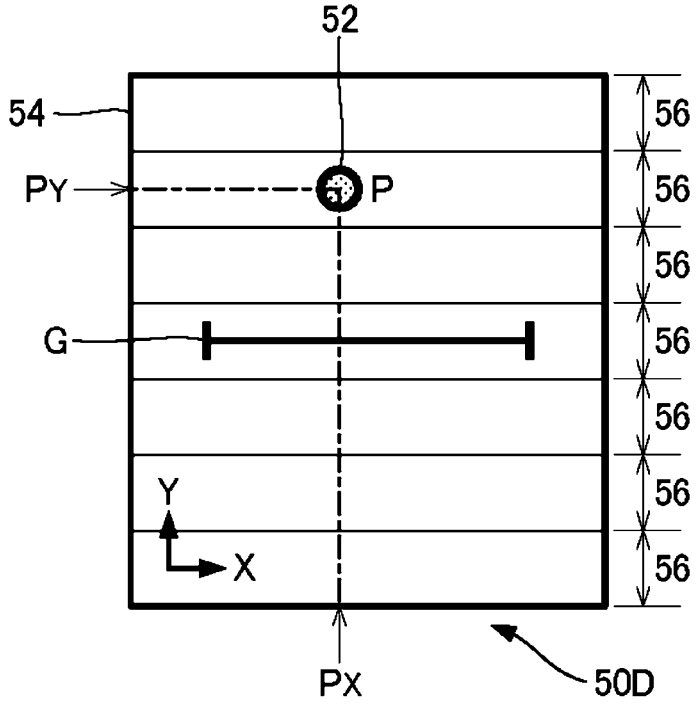
FIG. 11 illustrates a manipulation picture used in a fifth embodiment.

In the fifth embodiment, the display control unit 24 displays a manipulation picture 50D shown in FIG. 11 on the display device 14. The manipulation picture 50D is an image in which one manipulation path G is placed in a manipulation area 54 in which crossed (typically, orthogonal) X and Y axes are set. The manipulation path G extends parallel with the X axis. Therefore, the Y axis is in a direction that crosses the manipulation path G having a reference position $P_B$ at one end. The user can specify any position in the manipulation area 54 as a manipulation position P. The manipulation determining unit 22 determines a position $P_X$ on the X axis and a position $P_Y$ on the Y axis that correspond to the manipulation position P. The display control unit 24 places a manipulation mark 52 at the manipulation position P($P_X$, $P_Y$) in the manipulation area 54.

The manipulation prediction unit 26 predicts an instruction time point $T_B$ on the basis of positions $P_X$ on the X axis corresponding to respective manipulation positions P by the same method as used in the first embodiment. In the fifth embodiment, the voice synthesizing unit 28 generates a portion of a voice signal Z having a pitch $S_A$ corresponding to the position $P_Y$ on the Y axis of the manipulation position P. As is understood from the above description, the X axis and the Y axis in the manipulation area 54 correspond to the time axis and the pitch axis, respectively.

More specifically, as illustrated in FIG. 11, the manipulation area 54 is divided into plural regions 56 corresponding to different pitches. The regions 56 are band-shaped regions that extend in the X-axis direction and are arranged in the Y-axis direction. The voice synthesizing unit 28 generates a portion of a voice signal Z having a pitch $S_A$ corresponding to the region 56 where the manipulation position P exists among the plural regions 56 of the manipulation area 54 (i.e., a pitch $S_A$ corresponding to the position $P_Y$). More specifically, for example, a portion of a voice signal Z having a pitch $S_A$ corresponding to the region 56 where the manipulation position P exists is generated at a time point when the position $P_X$ reaches a prescribed position (e.g., reference position $P_B$ or vocalization start position $P_A$) on the manipulation path G. That is, use of the pitch $S_A$ is determined at the time point when the manipulation position (position $P_X$) reaches the prescribed position. As described above, in the fifth embodiment, as in the second embodiment, it is possible to omit pitches $S_A$ of respective notes in synthesis information S because the pitch $S_A$ is controlled in accordance with the manipulation position P.

As is understood from the above description, as in the first embodiment the vocalization time point of each note (or phoneme) can be specified on a real-time basis in accordance with the position $P_X$ of the manipulation position P on the X axis by moving the manipulation position P to any point in the manipulation area 54 by manipulating the manipulation device 16. Furthermore, the pitch $S_A$ of each note of a song is controlled in accordance with the position $P_Y$ of the manipulation position P on the Y axis. As such, the fifth embodiment provides the same advantages as the second embodiment.

<Modifications>

Each of the above embodiments can be modified in various manners. Specific example modifications will be described below. It is possible to combine, as appropriate, two or more, selected at will, of the following example modifications.

(1) In each of the above embodiments, vocalization start positions $P_A$ and prediction execution positions $C_E$ are set for respective kinds of phonemes $Q_1$. However, it is possible to set different vocalization start positions $P_A$ and different prediction execution positions $C_E$ may be set for respective combinations of kinds of phonemes $Q_1$ and $Q_2$ constituting vocalization codes $S_B$.

(2) It is possible to control an acoustic characteristic of a voice signal Z according to a manipulation on the manipulation picture 50 (50A, 50B, 50C, or 50D). For example, a configuration is possible in which the voice synthesizing unit 28 imparts a vibrato to a voice signal Z when the user reciprocates the manipulation position P in the Y direction (vertical direction) that is perpendicular to the X direction during or after a vocalization commanding manipulation. More specifically, a voice signal Z is given a vibrato whose depth (pitch variation range) corresponds to a reciprocation amplitude of the manipulation position P in the Y direction and whose rate (pitch variation cycle) corresponds to a reciprocation cycle of the manipulation position P. For example, a configuration is also possible in which the voice synthesizing unit 28 imparts, to a voice signal Z, an acoustic effect (e.g., reverberation effect) that corresponds, in degree, to a movement length of the manipulation position P in the Y direction when the user moves the manipulation position P in the Y direction during or after a vocalization commanding manipulation.

(3) Each of the above embodiments is directed to the case that the manipulation device 16 is a touch panel and the user makes a vocalization commanding manipulation on the manipulation picture 50 which is displayed on the display device 14. However, it is possible to employ a manipulation device 16 that is equipped with a real manipulation member to be manipulated by the user. For example, in the case of a slider-type manipulation device 16 whose manipulation member (knob) is to be moved straightly, a position of the manipulation member corresponds to a manipulation position P in each embodiment. Another configuration is possible in which the user indicates a manipulation position P using a pointing device such as a mouse as a manipulation device 16.

(4) In each of the above embodiments, an instruction time point $T_B$ is predicted before the manipulation position P reaches a reference position $P_B$ actually. However, it is possible to generate a portion of a voice signal Z by employing, as an instruction time point $T_B$, a time point (real instruction time point) when the manipulation position P reaches a reference position $P_B$ actually. However, where a synthesis unit $V_B$ having a phoneme $Q_1$ and a phoneme $Q_2$ (the former precedes the latter) of a phoneme chain (diphone) is used and vocalization of the synthesis unit $V_B$ is started at a time point when the manipulation position P reaches a reference position $P_B$ actually, as described above vocalization of the phoneme $Q_2$ may be started at a time point that is delayed from a user-intended time point (real instruction time point). Therefore, from the viewpoint of causing each note to be pronounced at a user-intended time point accurately, it is preferable to predict an instruction time point $T_B$ before the manipulation position P reaches the reference position $P_B$ actually, as in each of the above embodiments.

(5) In each of the above embodiments, the vocalization start position $P_A$ and the prediction execution position $C_E$ are controlled variably in accordance with the kind of the phoneme $Q_1$. However, it is possible to fix the vocalization start position $P_A$ or the prediction execution position $C_E$ at a prescribed position. Furthermore, although in each of the above embodiments the left end $E_L$ and the right end $E_R$ are employed as a prediction start time point $C_S$ and a reference position $P_B$, respectively, positions other than the end positions $E_L$ and $E_R$ of the manipulation path G may be employed as a prediction start time point $C_S$ and a reference position $P_B$. For example, a configuration is possible in which a position that is spaced from the left end $E_L$ to the side of the right end $E_R$ by a prescribed distance may be employed as a prediction start time point $C_S$. And a configuration is possible in which a position that is spaced from the right end $E_R$ to the side of the left end $E_L$ by a prescribed distance.

(6) Although in each of the above embodiments the manipulation path G is a straight line, it is possible to employ a curved manipulation path G. For example, it is possible to set positions $P_A$, $P_B$, $C_S$, and $C_E$ on a circular manipulation path G. In this case, the user performs, for each note, a manipulation (vocalization commanding manipulation) of drawing a circle along the manipulation path G on the display screen so that the manipulation position P reaches the reference position $P_B$ on the manipulation path G at a desired time point.

Each of the above embodiments is directed to synthesis of a Japanese voice, the language of a voice to be synthesized is not limited to Japanese and may be any language. For example, it is possible to apply each of the above embodiments to generation of a voice of any language such as English, Spanish, Chinese, or Korean. In languages in which one vocalization code $S_B$ may consist of two consonant phonemes, both phonemes $Q_1$ and $Q_2$ may be a consonant phoneme. Furthermore, in certain language systems (e.g., English), one of both of a first phoneme $Q_1$ and a second phoneme $Q_2$ may consist of plural phonemes (phoneme chain). For example, in the first syllable "sep" of the word "September," a configuration is possible in which phonemes (phoneme chain) "se" are made first phonemes $Q_1$ and a phoneme "p" is made a second phoneme $Q_2$ and a transition between them is controlled. Another configuration is possible in which a phoneme "s" is made a first phoneme $Q_1$ and phonemes (phoneme chain) "ep" is made second phonemes $Q_2$ and a transition between them is controlled. For example, where to set a boundary between the first phoneme $Q_1$ and the second phoneme $Q_2$ of one syllable (in the above example, whether the syllable "sep" should be divided into phonemes "se" and "p" or phonemes "s" and "ep") is determined according to predetermined rules or a user instruction.

Here, the above embodiments are summarized as follows.

There is provided a voice synthesizing apparatus according to the present disclosure includes a manipulation determiner for determining a manipulation position which is moved according to a manipulation of a user; and a voice synthesizer which, in response to an instruction to generate a voice in which a second phoneme (e.g., phoneme Q2) follows a first phoneme (e.g., phoneme Q1), generates a voice signal so that vocalization of the first phoneme starts before the manipulation position will reach a reference position and that vocalization from the first phoneme to the second phoneme is made when the manipulation position reaches the reference position. This configuration makes it possible to control a time point when the vocalization from the first phoneme to the second phoneme is made, on a real-time basis according to a user manipulation.

A voice synthesizing apparatus according to a preferable mode of the present disclosure further includes a manipulation predictor for predicting an instruction time point when the manipulation position reaches the reference position on the basis of a movement speed of the manipulation position. This mode makes it possible to reduce the delay from the user-intended time point to a time point when vocalization of the second phoneme is started actually because the instruction time point is predicted before the manipulation position reaches the reference position actually. Although each of the first phoneme and the second phoneme is typically a single phoneme, plural phonemes (phoneme chain) may be employed as first phonemes or second phonemes.

In a voice synthesizing apparatus according to another preferable mode of the present disclosure, the manipulation predictor predicts the instruction time point on the basis of a time length that the manipulation position takes to move from a prediction start position to a prediction execution position. In a voice synthesizing apparatus according to still another preferable mode of the present disclosure, the manipulation predictor sets the prediction execution position variably in accordance with a kind of the first phoneme. These modes make it possible to enable prediction that reflects a movement of the manipulation position in an interval, suitable for a kind of the first phoneme, of the manipulation path. The phrase "to set the prediction execution position variably in accordance with the kind of the phoneme" means that the prediction execution position is different when the first phoneme is a particular phoneme A and the first phoneme is a phoneme B that is different from the phoneme A, and does not necessitate that different prediction execution positions be set for all kinds of phonemes.

In a voice synthesizing apparatus according to another preferable mode of the present disclosure, the voice synthesizer generates the voice signal for vocalizing a synthesis unit (e.g., synthesis unit $V_A$) having the first phoneme on the end side at a time point when the manipulation position that is moving toward the reference position passes a vocalization start position. In a voice synthesizing apparatus according to still another preferable mode of the present disclosure, the voice synthesizer sets the vocalization start position variably in accordance with the kind of the first phoneme. These modes make it possible to start vocalization of the first phoneme at a time point that is suitable for a kind of the first phoneme. The phrase "to set the vocalization start position variably in accordance with the kind of the phoneme" means that the vocalization start position is different when the first phoneme is a particular phoneme A and the first phoneme is a phoneme B that is different from the phoneme A, and does not necessitate that different vocalization start positions be set for all kinds of phonemes.

In a voice synthesizing apparatus according to another preferable mode of the present disclosure, the voice synthesizer generates a voice signal having a pitch that corresponds to a subject manipulation path along which the user moves the manipulation position among plural manipulation paths corresponding to different pitches. This mode provides an advantage that the user can control, on a real-time basis, not only the vocalization time point but also the voice pitch because a voice having a pitch corresponding to a subject manipulation path along which the user moves the manipulation position is generated. A specific example of this mode will be described later as a second embodiment, for example.

In a voice synthesizing apparatus according to still another preferable mode of the present disclosure, the voice synthesizer generates a voice signal for a vocalization code that corresponds to a subject manipulation path along which the user moves the manipulation position among plural manipulation paths corresponding to different vocalization codes. This mode provides an advantage that the user can control, on a real-time basis, not only the vocalization time point but also the vocalization code because a voice signal for a vocalization code corresponding to a subject manipulation path along which the user moves the manipulation position is generated. A specific example of this mode will be described later as a third embodiment, for example.

In a voice synthesizing apparatus according to yet another preferable mode of the present disclosure, the voice synthesizer generates a voice signal having a pitch that corresponds to a manipulation position that is located at a position in a direction that crosses the manipulation path having the reference position at one end. Also, the voice synthesizer generates a voice signal having an acoustic effect that corresponds to a manipulation position that is located at a position in a direction that crosses the manipulation path extending toward the reference position. These mode provide an advantage that the user can control, on a real-time basis, not only the vocalization time point but also the voice pitch or the acoustic effect because a voice having a pitch or an acoustic effect corresponding to a manipulation position that is located at a position in a direction (e.g., Y-axis direction) that crosses the manipulation path is generated. A specific example of this mode will be described later as a fifth embodiment, for example.

In a voice synthesizing apparatus according to a further preferable mode of the present disclosure, when an instruction to generate a voice in which a second phoneme follows a first phoneme and a voice in which a fourth phoneme follows a third phoneme is made, the voice synthesizer generates a voice signal so that vocalization of the first phoneme starts before the manipulation position reaches a first reference position as a result of movement along the manipulation path in a first direction and that vocalization from the first phoneme to the second phoneme is made when the manipulation position reaches the reference position, and generates a voice signal so that vocalization of the third phoneme starts before the manipulation position reaches a second reference position as a result of movement along the manipulation path in a second direction that is opposite to the first direction and that vocalization from the third phoneme to the fourth phoneme is made when the manipulation position reaches the reference position. In this mode, a time point when the vocalization from the first phoneme to the second phoneme is controlled by a manipulation of moving the manipulation position in the first direction and a time point when the vocalization from the third phoneme to the fourth phoneme is controlled by a manipulation of moving the manipulation position in the second direction. This makes it possible to reduce the load that the user bears in making a manipulation for commanding a vocalization time point of each voice.

The voice synthesizing apparatus according to each of the above modes is implemented by hardware (electronic circuit) such as a DSP (digital signal processor) that is dedicated to generation of a voice signal or through cooperation between a program and a general-purpose computing device such as a CPU (central processing unit). More specifically, a program according to the present disclosure causes a computer to execute a determining step of determining a manipulation position which is moved according to a manipulation of a user; and a generating step of generating, in response to an instruction to generate a voice in which a second phoneme follows a first phoneme, a voice signal so that vocalization of the first phoneme starts before the manipulation position will reach a reference position and that vocalization from the first phoneme to the second phoneme is made when the manipulation position reaches the reference position. The program according to this mode can be provided in such a form as to be stored in a computer-readable recording medium and installed in a computer. For example, the recording medium is a non-transitory recording medium a typical example of which is an optical recording medium such as a CD-ROM. However, the recording medium may be any of recording media of other known forms such as semiconductor recording media and magnetic recording media. Furthermore, for example, the program according to the present disclosure can be provided in the form of delivery over a communication network and installed in a computer.

Although the present disclosure has been illustrated and described for the particular preferred embodiments, it is apparent to a person skilled in the art that various changes and modifications can be made on the basis of the teachings of the present disclosure. It is apparent that such changes and modifications are within the spirit, scope, and intention of the present disclosure as defined by the appended claims.

The present application is based on Japanese Patent Application No. 2013-033327 filed on Feb. 22, 2013 and Japanese Patent Application No. 2014-006983 filed on Jan. 17, 2014, the contents of which are incorporated herein by reference.

What is claimed is:

1. A voice synthesizing method comprising:

determining a manipulation position which is moved according to a user's manipulation for moving the manipulation position, wherein the user's manipulation is made on a manipulation device;

generating, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position; and predicting an instruction time point when the moving manipulation position reaches the reference position on the basis of a movement speed of the moving manipulation position.

2. The voice synthesizing method according to claim 1, wherein, in the predicting, the instruction time point is predicted on the basis of a time length that the moving manipulation position takes to move from a prediction start position to a prediction execution position.

3. The voice synthesizing method according to claim 2, wherein the prediction execution position is variably set in accordance with a kind of the first phoneme.

4. The voice synthesizing method according to claim 1, wherein, in the generating, the generated voice signal is a voice signal for vocalizing a synthesis unit at a time point when the moving manipulation position that is moving toward the reference position passes a vocalization start position, the synthesis unit having the first phoneme.

5. The voice synthesizing method according to claim 4, wherein the vocalization start position is variably set in accordance with a kind of the first phoneme.

6. The voice synthesizing method according to claim 1, wherein, in the generating, the generated voice signal is a voice signal having an acoustic effect based on movement of the moving manipulation position in a direction that crosses the manipulation path, the manipulation path extending in another direction toward the reference position.

7. The voice synthesizing method according to claim 1, wherein, in the generating, the instruction to generate the voice is an instruction to generate a voice in which the second phoneme follows the first phoneme and a voice in which a fourth phoneme follows a third phoneme, wherein, the generating is generating, in response to the instruction:

the voice signal so that the vocalization of the first phoneme starts before the moving manipulation position reaches the reference position as a first reference position as a result of movement of the moving manipulation position along a manipulation path in a first direction and that the vocalization from the first phoneme to the second phoneme is made when the moving manipulation position reaches the first reference position; and a voice signal so that vocalization of the third phoneme starts before the moving manipulation position reaches a second reference position as a result of movement of the moving manipulation position along the manipulation path in a second direction that is opposite to the first direction and that vocalization from the third phoneme to the fourth phoneme is made when the moving manipulation position reaches the second reference position.

8. A voice synthesizing method comprising:

determining a manipulation position which is moved according to a user's manipulation for moving the manipulation position, wherein the user's manipulation is made on a manipulation device;

generating, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein, in the generating, the generated voice signal is a voice signal having a pitch that corresponds to a manipulation path along which the moving manipulation position is moved, among plural manipulation paths corresponding to different pitches.

9. A voice synthesizing method comprising:

determining a manipulation position which is moved according to a user's manipulation for moving the manipulation position, wherein the user's manipulation is made on a manipulation device;

generating, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein, in the generating, the generated voice signal is a voice signal for a vocalization code that corresponds to a manipulation path, along which the moving manipulation position is moved, among plural manipulation paths corresponding to different vocalization codes.

10. A voice synthesizing method comprising:

determining a manipulation position which is moved according to a user's manipulation for moving the manipulation position, wherein the user's manipulation is made on a manipulation device;

generating, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein, in the generating, the generated voice signal is a voice signal having a pitch that corresponds to where the moving manipulation position is located in a direction that crosses a manipulation path, the manipulation path extending in another direction toward the reference position.

11. A voice synthesizing apparatus comprising:

a non-transitory recording medium configured to store one or more programs;

a computer, when executing the one or more programs, configured to:

determine a manipulation position which is moved according to a user's manipulation for moving the manipulation position, wherein the user's manipulation is made on a manipulation device;

generate, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position; and predict an instruction time point when the moving manipulation position reaches the reference position on the basis of a movement speed of the moving manipulation position.

12. The voice synthesizing apparatus according to claim 11, wherein the instruction time point is predicted on the basis of a time length that the moving manipulation position takes to move from a prediction start position to a prediction execution position.

13. The voice synthesizing apparatus according to claim 12, wherein the computer, when executing the one or more programs, manipulation predictor is configured to set the prediction execution position variably in accordance with a kind of the first phoneme.

14. The voice synthesizing apparatus according to claim 11, wherein the generated voice signal is a voice signal for vocalizing a synthesis unit at a time point when the moving manipulation position that is moving toward the reference position passes a vocalization start position, the synthesis unit having the first phoneme.

15. The voice synthesizing apparatus according to claim 14, wherein the computer, when executing the one or more programs, is configured to set the vocalization start position variably in accordance with a kind of the first phoneme.

16. The voice synthesizing apparatus according to claim 11, wherein the generated voice signal is a voice signal having an acoustic effect based on movement of the moving manipulation position in a direction that crosses the manipulation path, the manipulation path extending in another direction toward the reference position.

17. The voice synthesizing apparatus according to claim 11, wherein the instruction to generate the voice is an instruction to generate a voice in which the second phoneme follows the first phoneme and a voice in which a fourth phoneme follows a third phoneme, wherein the computer, when executing the one or more programs, is configured to generate:

the voice signal so that the vocalization of the first phoneme starts before the moving manipulation position reaches the reference position as a first reference position as a result of movement of the moving manipulation position along a manipulation path in a first direction and that the vocalization from the first phoneme to the second phoneme is made when the moving manipulation position reaches the first reference position; and a voice signal so that vocalization of the third phoneme starts before the moving manipulation position reaches a second reference position as a result of movement of the moving manipulation position along the manipulation path in a second direction that is opposite to the first direction and that vocalization from the third phoneme to the fourth phoneme is made when the moving manipulation position reaches the second reference position.

18. A voice synthesizing apparatus comprising:

a non-transitory recording medium configured to store one or more programs;

a computer, when executing the one or more programs, configured to:

determine a manipulation position which is moved according to a user's manipulation for moving the manipulation position, wherein the user's manipulation is made on a manipulation device; and generate, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein the generated voice signal is a voice signal having a pitch that corresponds to a manipulation path along which the moving manipulation position is moved, among plural manipulation paths corresponding to different pitches.

19. A voice synthesizing apparatus comprising:

a non-transitory recording medium configured to store one or more programs;

a computer, when executing the one or more programs, configured to:

determine a manipulation position which is moved according to a user's manipulation for moving the manipulation position, wherein the user's manipulation is made on a manipulation device; and generate, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein the generated voice signal is a voice signal for a vocalization code that corresponds to a manipulation path along which the moving manipulation position is moved, among plural manipulation paths corresponding to different vocalization codes.

20. A voice synthesizing apparatus comprising:

a non-transitory recording medium configured to store one or more programs;

a computer, when executing the one or more programs, configured to:

determine a manipulation position which is moved according to a user's manipulation for moving the manipulation position, wherein the user's manipulation is made on a manipulation device; and generate, in response to an instruction to generate a voice in which a second phoneme follows a first phoneme, a voice signal so that vocalization of the first phoneme starts before the moving manipulation position reaches a reference position and that vocalization from the first phoneme to the second phoneme is made when the moving manipulation position reaches the reference position, wherein the generated voice signal is a voice signal having a pitch that corresponds to where the moving manipulation position is located in a direction that crosses a manipulation path, the manipulation path extending in another direction toward the reference position.

* * * * *